US010114330B2

(12) United States Patent
Meguro

(10) Patent No.: US 10,114,330 B2
(45) Date of Patent: Oct. 30, 2018

(54) CLEANING APPARATUS WITH SCRAPING MEMBER, AND IMAGE FORMING APPARATUS INCLUDING THE SAME

(71) Applicant: Konica Minolta, Inc., Tokyo (JP)

(72) Inventor: Taichi Meguro, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/688,780

(22) Filed: Apr. 16, 2015

(65) Prior Publication Data

US 2015/0346673 A1 Dec. 3, 2015

(30) Foreign Application Priority Data

May 28, 2014 (JP) ..... 2014-109727

(51) Int. Cl.

| | |
|---|---|
| ***G03G 21/00*** | (2006.01) |
| ***B08B 1/00*** | (2006.01) |
| ***B03C 7/06*** | (2006.01) |
| ***B03C 7/08*** | (2006.01) |

(52) U.S. Cl.

CPC ..... *G03G 21/0011* (2013.01); *B03C 7/06* (2013.01); *B03C 7/08* (2013.01); *B08B 1/005* (2013.01); *B08B 1/007* (2013.01); *G03G 21/007* (2013.01); *G03G 21/0029* (2013.01); *G03G 21/0058* (2013.01)

(58) Field of Classification Search

CPC .. G03G 21/0011; G03G 21/007; G03G 21/10; G03G 21/0058; G03G 21/0029; G03G 15/0812; B08B 1/005

See application file for complete search history.

(56) References Cited

U.S. PATENT DOCUMENTS

| | | | | |
|---|---|---|---|---|
| 3,859,691 | A * | 1/1975 | Katayama ..... | G03G 21/0029 15/256.51 |
| 4,939,551 | A * | 7/1990 | Hashiyama ..... | G03G 21/0029 399/351 |
| 7,929,880 | B2 | 4/2011 | Kobashi | |

(Continued)

FOREIGN PATENT DOCUMENTS

| | | |
|---|---|---|
| CN | 102203684 A | 9/2011 |
| JP | S5445450 | 10/1979 |

(Continued)

OTHER PUBLICATIONS

Rejection Notice dated Jul. 5, 2016 for Japanese Patent Application No. 2014-109727, with English translation, 14 pages.

(Continued)

*Primary Examiner* — David M Gray
*Assistant Examiner* — Laura Roth
(74) *Attorney, Agent, or Firm* — Squire Patton Boggs (US) LLP

(57) ABSTRACT

A cleaning apparatus includes a scraper and a support member. The scraper is in contact with a surface of a recovery roller to clean out residuals from the surface. A base portion of the scraper is held between and a fixing plate and a supporting plate. In this case, a leading end of the scraper is in contact with the surface of the recovery roller while an edge of the supporting plate serving as a fulcrum. Also, a base length d of the scraper from the fulcrum to the base portion is selected to make uniform the contact pressure of the scraper.

8 Claims, 6 Drawing Sheets

(56) References Cited

U.S. PATENT DOCUMENTS

| | | | | |
|---|---|---|---|---|
| 9,575,438 | B2 * | 2/2017 | Takai | G03G 15/161 |
| 2007/0217813 | A1 * | 9/2007 | Miyamoto | G03G 15/161 399/101 |
| 2009/0129810 | A1 * | 5/2009 | Kobashi | G03G 15/161 399/101 |
| 2014/0037315 | A1 * | 2/2014 | Tabata | G03G 21/0005 399/71 |
| 2015/0220024 | A1 * | 8/2015 | Yoshioka | G03G 15/1605 399/101 |

FOREIGN PATENT DOCUMENTS

| | | | | |
|---|---|---|---|---|
| JP | 61073179 | A * | 4/1986 | |
| JP | 02078974 | B * | 6/1990 | G03G 21/00 |
| JP | H03288185 | A | 12/1991 | |
| JP | H04191765 | A | 7/1992 | |
| JP | 2001142246 | A * | 5/2001 | |
| JP | 2003-241599 | | 8/2003 | |
| JP | 2004-077762 | | 3/2004 | |
| JP | 2005055694 | A * | 3/2005 | |
| JP | 2005055694 | A | 3/2005 | |
| JP | 2007-188058 | A | 7/2007 | |
| JP | 2007188058 | A * | 7/2007 | |
| JP | 2009-122411 | | 6/2009 | |
| JP | 2011-141481 | | 7/2011 | |
| JP | 2011191624 | A * | 9/2011 | |

OTHER PUBLICATIONS

Rejection Notice dated Jan. 31, 2017 for Japanese Patent Application No. 2014-109727, with English translation, 10 pages.

First Notice of the Opinion on Examination and a Search Report dated May 17, 2017 in Chinese Patent Application No. 201510280336.2 with English translation; 18 pages.

Office Action dated Jan. 12, 2018, in Chinese Patent Application No. 201510280336.2, 17 pages including English translation.

Office Action dated May 24, 2018 in Chinese Patent Application No. 201510280336.2, 17 pages.

* cited by examiner

Fig.3A
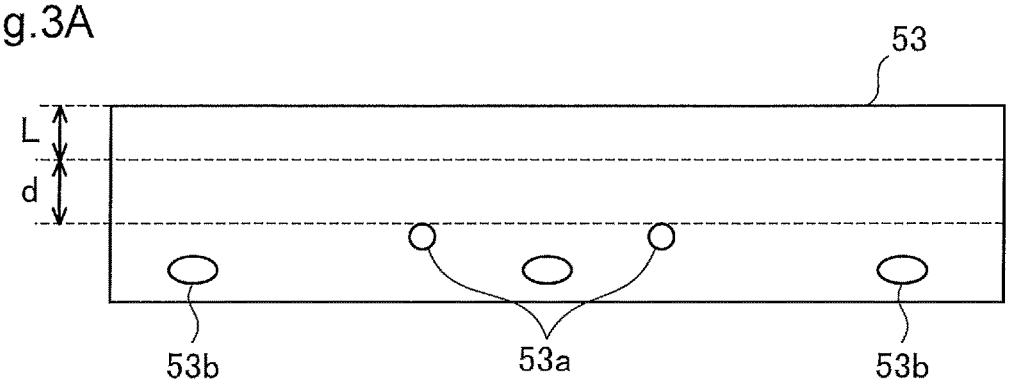
Fig.3B
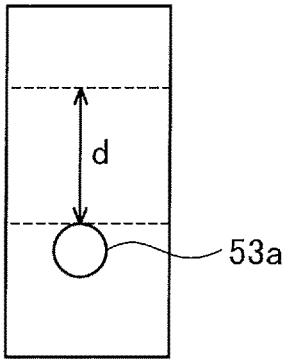
Fig.4
| | | Distance d between Fulcrum and Positioning Hole | | | | | |
|---|---|---|---|---|---|---|---|
| | | 4mm | 6mm | 8mm | 10mm | 12mm | 14mm |
| Free Length L (Contact Pressure) | 4mm (260N/m) | × | × | × | × | × | ○ |
| | 6mm (80N/m) | × | × | ○ | ○ | ○ | ○ |
| | 8mm (30N/m) | × | × | ○ | ○ | ○ | ○ |
| | 10mm (15N/m) | × | ○ | ○ | ○ | ○ | ○ |
| | 12mm (10N/m) | ○ | ○ | ○ | ○ | ○ | ○ |

CLEANING APPARATUS WITH SCRAPING MEMBER, AND IMAGE FORMING APPARATUS INCLUDING THE SAME

CROSS-REFERENCE TO RELATED APPLICATIONS

The present application claims priority under 35 U.S.C. § 119 to Japanese Patent Application No. 2014-109727, filed May 28, 2014. The contents of this application are herein incorporated by reference in their entirety.

FIELD OF INVENTION

The present invention relates to a cleaning apparatus and an image forming apparatus.

DESCRIPTION OF THE RELATED ART

Conventionally, an image forming apparatus capable of forming full-color images with a plurality of photoreceptor drums arranged in contact with one intermediate transfer belt is known. This image forming apparatus forms an image by performing a series of processes which includes forming an image on an image bearing member, and transferring and fixing the image to the sheet. This image forming apparatus is provided with a cleaning apparatus which is used to clean out the toner remaining on the image bearing member.

The cleaning apparatus is provided with a plate-like scraping member such as called a scraper which comes in contact with the surface of a member to be cleaned to remove residuals on the surface. The scraping member may be used by being in contact with the image bearing member itself, or may be used with a plurality of rollers, such as a cleaning roller and a recovery roller, which are intervening between the image bearing member and the scraping member in order that the scraping member is in contact with the most downstream roller thereof, for example, the recovery roller (for example, refer to Japanese Patent Published Application No. 2011-141481).

While the scraping member is supported by a support member and brought in contact with the member to be cleaned, a sufficient scraping effect can be achieved only by having the scraping member abut on the member to be cleaned in a certain required condition. Because of this, a positioning hole is opened through the scraping member to support the scraping member in an appropriate position by inserting a boss member of the support member through the positioning hole. Also, if necessary, this scraping member is provided with a threaded hole with which the scraping member is fixed to the support member.

However, since the support rigidity of the scraping member is reduced due to the positioning hole and the threaded hole, the contact pressure of the scraping member tends to decrease in locations corresponding to these holes. On the other hand, in the case of an electric field cleaning system using application of a high bias voltage, discharge products derived from toner are attracted to the surface of the member to be cleaned. There is a problem that, when the contact pressure of the scraping member is lowered, it is difficult to remove the discharge products of this kind.

Taking into consideration the above circumstances, it is an object of the present invention therefore to provide a cleaning apparatus and an image forming apparatus in which a good cleaning performance can be achieved by inhibiting the contact pressure of a scraping member from partially lowering.

SUMMARY OF THE INVENTION

To achieve at least one of the above-mentioned objects, reflecting one aspect of the present invention, a cleaning apparatus comprises: a plate-like scraping member which is in contact with a surface of a member to be cleaned in order to clean out residuals from the surface of the member to be cleaned; and a support member configured to support the plate-like scraping member. The support member comprises: a supporting plate configured to support a base portion of the plate-like scraping member; and a fixing plate located opposite the supporting plate at a distance, which is larger than a thickness of the plate-like scraping member, from the supporting plate to hold the base portion of the plate-like scraping member between the fixing plate and the supporting plate. Furthermore, the support member has a leading end of the plate-like scraping member make contact with the surface of the member to be cleaned by making use of a edge of the supporting plate as a fulcrum, and the plate-like scraping member has a base length from a position of the fulcrum on the supporting plate to an engagement position at which the support member engages the plate-like scraping member, and the base length is determined in order to make uniform a contact pressure of the plate-like scraping member against the member to be cleaned.

In accordance with the present invention as described above, the cleaning apparatus preferably further comprises: a cleaning roller located in parallel with an image bearing member which bears toner, and positioned in contact with the image bearing member; a recovery roller located in parallel with the cleaning roller and positioned in contact with this cleaning roller; and a voltage application unit configured to generate an electric field by applying a voltage with the polarity opposite to that of toner. In this case, it is preferred that the plate-like scraping member is in contact with a surface of the recovery roller, as the member to be cleaned, in order to cleans out residuals from the surface of the recovery roller.

Also, in accordance with the present invention as described above, it is preferred that the plate-like scraping member is provided with a positioning hole through which a protruding dowel of the supporting plate is inserted to perform positioning the plate-like scraping member, and wherein the engagement position with the support member corresponds to a edge of the positioning hole.

Furthermore, in accordance with the present invention as described above, it is preferred that the plate-like scraping member has a Young's modulus of 1 to 400 GPa.

Still further, in accordance with the present invention as described above, it is preferred that a hardness of the recovery roller is equal to or higher than the hardness of the plate-like scraping member, and wherein the recovery roller has a surface roughness Rz of 0.25 to 2.00 μm.

BRIEF DESCRIPTION OF THE DRAWINGS

FIG. 3A and FIG. 3B are explanatory views for showing the configuration of a scraper of the image forming apparatus.

FIG. 4 is an explanatory view for showing the results of experiments for investigating the scraping capability of the scraper.

DETAILED DESCRIPTION OF THE PREFERRED EMBODIMENT

Figure 1:
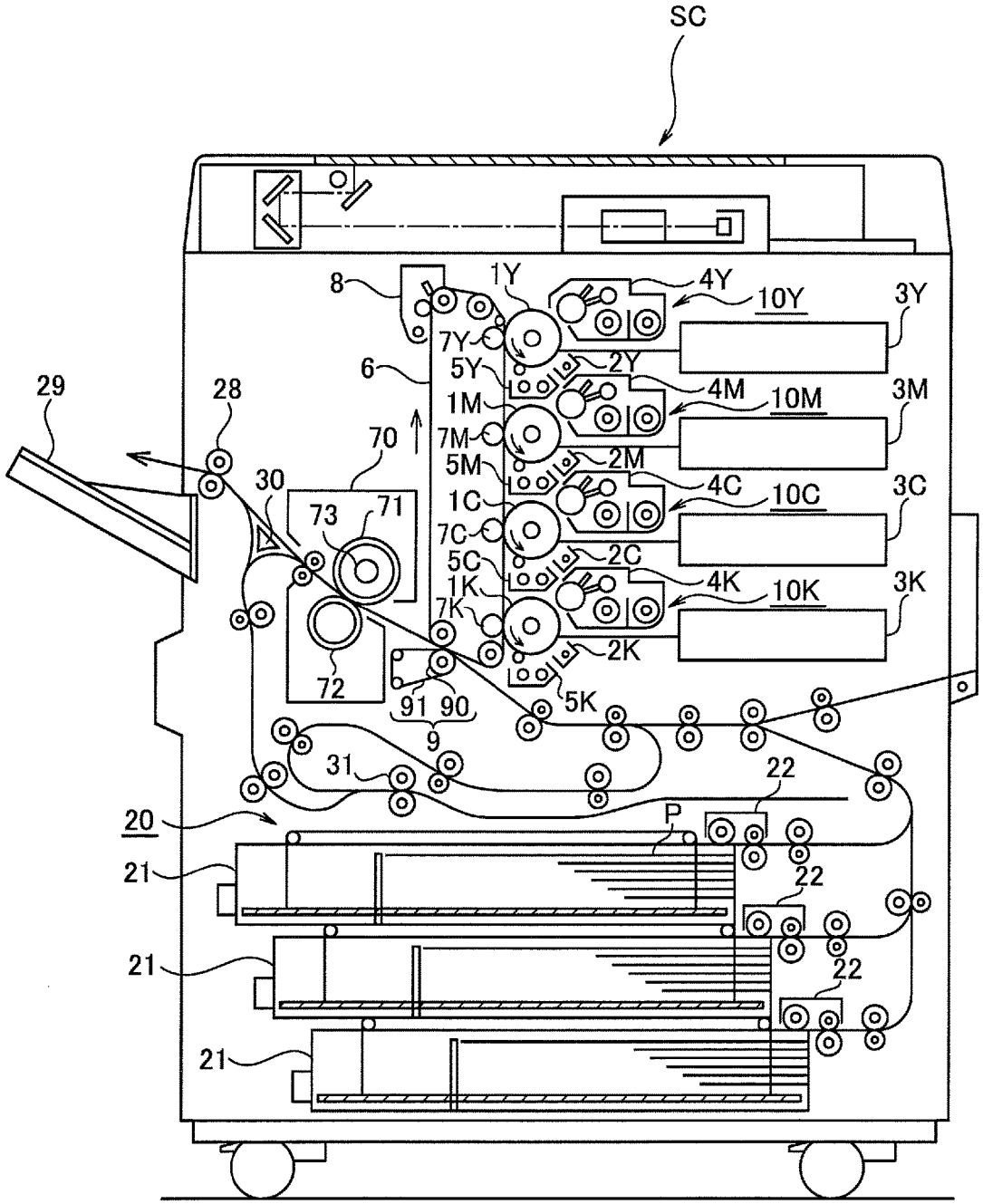
FIG. 1 is a view for schematically showing an image forming apparatus in accordance with the present embodiment.

FIG. 1 is a view for schematically showing the configuration of an image forming apparatus according to the present embodiment. This image forming apparatus is an electrophotographic image forming apparatus called a tandem color image forming apparatus. The tandem color image forming apparatus includes a plurality of photoreceptor drums vertically arranged in contact with one intermediate transfer belt to form full-color images.

The image forming apparatus consists mainly of an original reading unit SC, image forming units 10Y, 10M, 10C and 10K, a fixing unit 70, which are installed within one housing.

The original reading unit SC irradiates the image of an original with light emitted from a lighting unit, and reads the reflected light therefrom with a line image sensor to obtain image signals. The image signals are processed by performing A/D conversion, shading compensation, data compression and so on, and input to a control unit (not shown in the figure) as image data. Incidentally, the image data input to the control unit is not limited to the image data as captured by the original reading unit SC, but can be the data for example as received from another image forming apparatus, a personal computer or the like connected to the image forming apparatus, or stored in a portable recording medium such as a USB memory.

The image forming units 10Y, 10M, 10C and 10K correspond to a device for forming yellow (Y) images, a device for forming magenta (M) images, a device for forming cyan (C) color images, and a device for forming black (K) images respectively.

The image forming unit 10Y is provided with a photoreceptor drum 1Y for bearing an image of a predetermined color (yellow (Y)), and a charging unit 2Y, an optical writing unit 3Y, a development apparatus 4Y and a drum cleaner 5Y which are arranged around the photoreceptor drum 1Y.

The photoreceptor drum 1Y is uniformly charged with electricity by the charging unit 2Y, and the optical writing unit 3Y performs a scanning exposure process to form a latent image on the photoreceptor drum 1Y. The development apparatus 4Y then makes visible the latent image on the photoreceptor drum 1Y by developing the image with toner. A toner image (toner image) is thereby formed on the photoreceptor drum 1Y corresponding to yellow.

The image formed on the photoreceptor drum 1Y is transferred to a predetermined location of an intermediate transfer belt 6 through a first transfer roller 7Y.

Likewise, the other image forming units 10M, 10C and 10K are provided with photoreceptor drums 1M, 1C and 1K, and charging units 2M, 2C and 2K, optical writing units 3M, 3C and 3K, development apparatuses 4M, 4C and 4K, drum cleaners 5M, 5C and 5K which are arranged around the photoreceptor drums 1M, 1C and 1K respectively. These elements have the similar structure and function as the image forming unit 10Y.

The image consisting of respective color images transferred to the intermediate transfer belt 6 is transferred to a sheet P with a predetermined timing by a second transfer unit 9. After transferring the image, the intermediate transfer belt 6 is cleaned by a belt cleaning unit 8.

The second transfer unit 9 consists of a plurality of support rollers including an opposite roller 90 and a second transfer belt 91 which is wound around the support rollers. The second transfer unit 9 is provided in contact with the intermediate transfer belt 6 under pressure to form a transfer nip therebetween. When a sheet P is passed through this transfer nip, the image on the intermediate transfer belt 6 is transferred to the sheet P.

The paper feed unit 20 conveys a sheet P along a conveyance route. Sheets P are stored in paper feed trays 21, extracted from the paper feed tray 21 and transferred to the conveyance route by paper feed units 22. A plurality of conveyance units for conveying sheets P are provided on this conveying route. Each conveyance unit consists of a pair of rollers which are urged against each other. At least one of the pair of rollers is rotated by a drive mechanism consisting of an electric motor. Then, each conveyance unit holds a sheet P between the pair of rollers which are rotated to convey the sheet P. Meanwhile, in place of a pair of rollers, any other appropriate combination such as a combination of belts, a combination of a belt and a roller or the like combination can be used as a pair of rotary members serving as a conveyance unit.

The fixing unit 70 is a device which performs a fixing process for fixing an image to a sheet P to which the image has been transferred. The fixing unit 70 is provided with a fixing roller 71 and a pressure roller 72 which are arranged in contact with each other under pressure to form a nip (fixing nip) therebetween, and a heating device 73 for heating the fixing roller 71. The fixing unit 70 conveys a sheet P and fixes an image to the sheet P by pressure fixing with the fixing roller 71 and the pressure roller 72 and thermal fixing with the fixing heater 73.

After the fixing unit 70 processes the sheet P by the fixing treatment, the sheet P is discharged by discharging rollers 28 to a catch tray 29 which is attached to the external side of the housing. In the case where an image is to be formed also on the back side of the sheet P, the sheet P with the image formed on the front side is conveyed to reversing rollers 31 located below through a switching gate 30. The reversing rollers 31 hold the tail end of the sheet P which is conveyed therebetween and then reverses the sheet P by sending back it to a refeeding conveyance route. The sheet P sent back to the refeed conveyance route is then returned to the transfer site again by a plurality of conveyance rollers provided for refeeding sheets.

Figure 2:
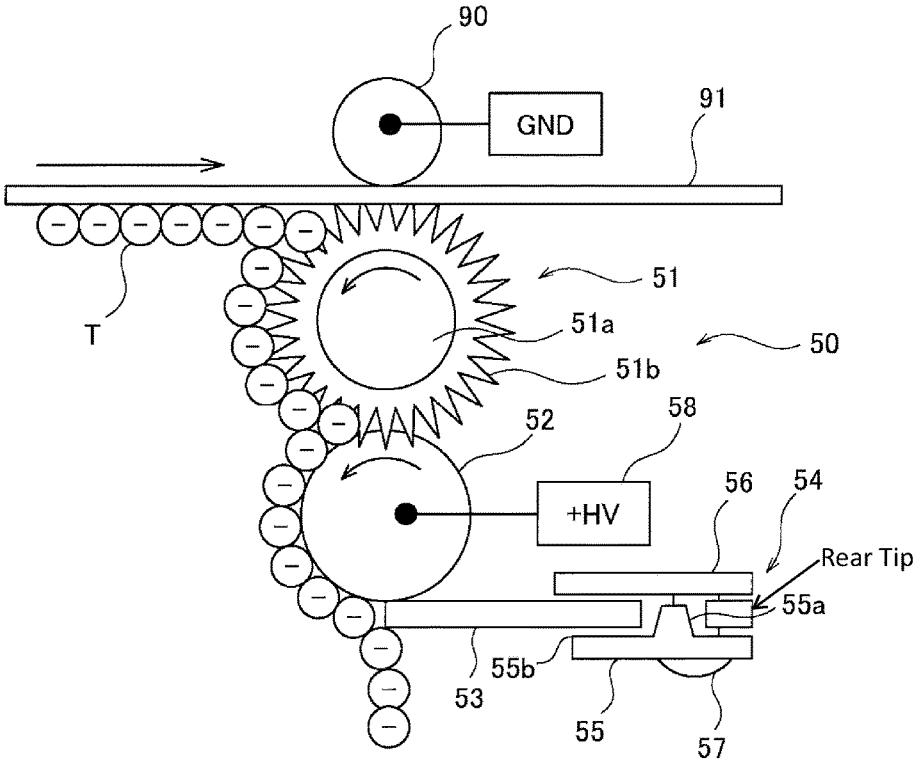
FIG. 2 is an explanatory view for schematically showing a second transfer cleaning unit of the image forming apparatus.

FIG. 2 is an explanatory view for schematically showing a second transfer cleaning unit 50. The second transfer cleaning unit 50 is a cleaning apparatus for cleaning the surface of the second transfer belt 91 of the image forming apparatus in accordance with the present embodiment. Meanwhile, illustration of the second transfer cleaning unit 50 is omitted in FIG. 1.

The second transfer cleaning unit 50 is implemented with an electric field cleaning system. That is, the second transfer cleaning unit 50 can clean the second transfer belt 91 by applying a bias voltage to a roller with the polarity opposite to that of toner T to be cleaned out, bringing this roller in contact with the second transfer belt 91, transfer toner T from the surface of the second transfer belt 91 to the roller.

The second transfer belt 91 is not necessarily limited with respect to material, thickness and hardness as long as having a semiconductive property. Nevertheless, it is possible to realize a good cleaning capability of the second transfer cleaning unit 50 by making use of an elastic belt having a volume resistivity of 8 to 11 log Ω·cm.

The second transfer cleaning unit 50 consists mainly of a cleaning roller 51, a recovery roller 52, a scraper 53 and a support member 54.

The cleaning roller 51 is a roller member which is rotatably supported. This cleaning roller 51 is located in parallel with the second transfer belt 91 which is an image bearing member for bearing toner T (residual toner) in order to make contact with the surface of the second transfer belt 91. Also, the cleaning roller 51 is located in a position opposite the opposite roller 90. The cleaning roller 51 is provided with a metal core 51*a* which is a solid or hollow rod member 51*a* made of a metallic conductive material, and a brush member 51*b* which is made of conductive brush fibers. It is possible for the cleaning roller 51 to maintain a good cleaning capability by setting the rotational speed thereof to 0.5 time to 1.5 times the rotational speed of the second transfer belt 91.

The metal core 51*a* is rotatably supported and driven to rotate in the same rotation direction as the second transfer belt 91 by a driving force transmitted from a drive motor (not shown in the figure) through a power transmission mechanism (not shown in the figure).

The brush member 51*b* consisting of the conductive fibers is planted around the outer circumference of the metal core 51*a* in order to make contact with the surface of the second transfer belt 91. The brush member 51*b* is made of a resin such as nylon, polyester, acryl or rayon in which carbon is dispersed to impart conductivity. A good cleaning capability can be obtained by making use of a leiotrichous brush as the brush member 51*b* which is made of nylon and has a row fiber resistance of $10^7$ to $10^9\Omega$, a fineness of 2 to 6 D and a density of 100 to 450 kF/inch$^2$.

The recovery roller 52 is a metallic roller having a conductivity and rotatably supported. This recovery roller 52 is located in parallel with the cleaning roller 51 in order to make contact with the brush member 51*b* thereof. The recovery roller 52 is rotationally driven in the same rotation direction as the cleaning roller 51 by the driving force transmitted from the power transmission mechanism as described above.

Preferably, the recovery roller 52 has a hardness equal to or higher than that of the scraper 53 and a surface roughness Rz of 0.25 to 2.00 μm. It is thereby possible to inhibit the recovery roller 52 from being flawed. Particularly, if the surface roughness Rz is smaller than 0.25 μm, the surface of the recovery roller 52 is excessively mirror finished so that the friction with the scraper 53 is increased resulting in a greater initial torque. Conversely, if the surface roughness Rz is larger than 2.00 μm, toner T enters in the ruggedness of the surface so that the scraper 53 cannot sufficiently perform its function.

In the case where, from the view point of maintaining the nip stability with the second transfer unit 9, a roller showing certain elasticity is used as the cleaning roller 51, it is preferred that the recovery roller 52 has a higher hardness. The recovery roller 52 of the present embodiment is a metallic roller made of SUS 304, and made in contact with the cleaning roller 51 at a predetermined position to ensure a desired nip stability.

The scraper 53 is a member (scraping member) abutting on the surface of the recovery roller 52, which is the member to be cleaned, in order to scrape toner T off from the surface of the recovery roller 52 to clean out the toner T. The scraper 53 is made of a thin plate of iron, stainless steel or the like metallic material. The thickness, pressure contact angle, pressure contact force and the like of the scraper 53 are set in advance to appropriate values in accordance with the configuration of the system such as the type of toner, external additive for toner, the material of the recovery roller 52 and so forth. Incidentally, this scraper 53 will be described later in details.

The support member 54 is composed of a supporting plate 55 and a fixing plate 56 between which the scraper 53 is held and supported. For instance, screws 57 can be used to fasten the supporting plate 55 and the fixing plate 56 to each other, and fasten the scraper 53 between these plates 55 and 56.

The supporting plate 55 is formed in a rectangular shape which is long sideways in the width direction of the scraper 53 (the axial direction of the recovery roller 52). The supporting plate 55 supports and brings the scraper 53 in contact with the recovery roller 52 in predetermined contact conditions (contact angle, contact force) in relation to the recovery roller 52. This supporting plate 55 is located opposite the recovery roller 52 as seen from the scraper 53. Positioning dowels 55*a* are formed in prescribed positions of this supporting plate 55 for positioning the scraper 53. For example, the positioning dowels 55*a* are formed in two positions at equal distances from the center of the supporting plate 55 in the width direction thereof in order to prevent the scraper 54 from rotating.

The fixing plate 56 is formed in a rectangular shape, which is long sideways in the width direction of the scraper 53, for fixing the scraper 53 by pinching the base portion thereof between the fixing plate 56 and the supporting plate 55. This fixing plate 56 is located opposite the supporting plate 55 at a predetermined distance from the recovery roller 52 in the same side as the recovery roller 52 as seen from the scraper 53.

A voltage application unit 58 is connected to the recovery roller 52 to apply a bias voltage to the recovery roller 52. More specifically, a predetermined voltage having a polarity (plus) opposite the charged polarity (minus) of toner T is applied to the recovery roller 52 as the bias voltage. The bias voltage of the present embodiment is 200 to 2000 V to ensure a good cleaning capability. On the other hand, the opposite roller 90 is grounded. By this configuration, there is a circuit through which a direct current flows from the voltage application unit 58 through the recovery roller 52, the cleaning roller 51, the second transfer belt 91 and the opposite roller 90.

An electric field is generated in this circuit between the second transfer belt 91 and the cleaning roller 51 to exert an electrostatic force on toner T in the direction from the second transfer belt 91 toward the cleaning roller 51. On the other hand, an electric field is generated between the cleaning roller 51 and the recovery roller 52 to exert an electrostatic force on toner T in the direction from the cleaning roller 51 toward the recovery roller 52.

By the electric field thus generated, the toner T remaining on the surface of the second transfer belt 91 is thereby taken away from the second transfer belt 91 and attracted (absorbed) by the brush member 51*b* of the cleaning roller 51. The toner T absorbed by the brush member 51*b* is transferred to the recovery roller 52 and attracted by the surface thereof. The toner T attracted by the recovery roller 52 is scraped off by the scraper 53.

FIG. 3A and FIG. 3B are explanatory views for showing the configuration of the scraper 53. FIG. 3A is an explanatory view for schematically showing the overall configuration of the scraper 53. FIG. 3B is an explanatory view for schematically showing the main portion of the scraper 53. The scraper 53 is formed in a rectangular shape, which is long sideways in the axial direction of the recovery roller 52. As illustrated in FIG. 2, the scraper 53 is supported by the support member 54 at one end (base end) in the direction perpendicular to in the width direction of the scraper 53 while the other end (leading end) is a free end. The leading end of the scraper 53 is directed in the reverse (counter) direction to the rotation direction of the recovery roller 52 and brought in contact with the surface of the recovery roller 52. The length of the scraper 53 in the width direction is equal to or longer than that of the recovery roller 52.

Preferably, the scraper 53 is made of a material having a Young's modulus of 1 to 400 GPa. If the Young's modulus is smaller than 1 GPa, the scraper 53 wears itself so that the scraping capability can hardly be maintained over a long period of time. Conversely, if the Young's modulus is larger than 400 GPa, the scraper 53 itself can hardly be warped. The scraper 53 may thereby penetrate the recovery roller 52 to increase the torque.

Positioning holes 53*a* are opened through the scraper 53 in the base end side. The positioning holes 53*a* are located in correspondence with the positioning dowels 55*a*. In the case of the present embodiment, the positioning holes 53*a* are formed in two positions at equal distances from the center of the scraper 53 in the width direction thereof. As illustrated in FIG. 2, when the scraper 53 is held by the support member 54, the positional relationship between the supporting plate 55 and the scraper 53 can easily be determined by inserting the positioning dowels 55*a* into the positioning holes 53*a* of the scraper 53. The scraper 53 is supported by the support member 54 in order to maintain optimal contact conditions with the recovery roller 52 by this positioning mechanism.

Furthermore, in the base end side as seen from the positioning holes 53*a*, threaded holes 53*b* are opened through the scraper 53 to engage with the screws 57 (refer to FIG. 2). The positioning holes 53*a* of the present embodiment are formed in three positions including the center position of the scraper 53 and two positions located at equal distances from the center position in the width direction thereof.

Figure 8:
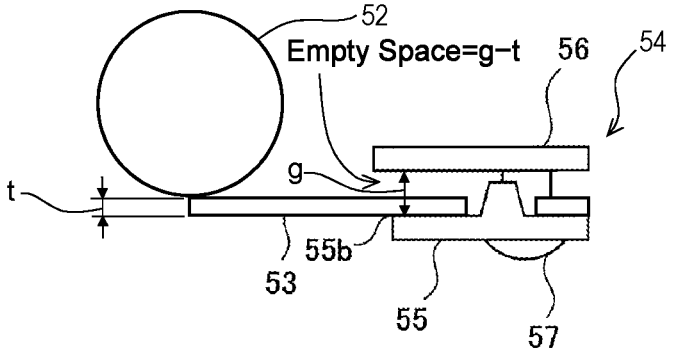
FIG. 8 is an explanatory view showing an example scraper.

The scraper 53 constructed as described above is supported by the support member 54 to be in contact with the recovery roller 52 in predetermined contact conditions (contact angle, contact force) in relation to the recovery roller 52. In these contact conditions, the scraper 53 is in contact with the edge 55*b* of the supporting plate 55 and supported with this edge 55*b* as a fulcrum, as shown in FIG. 8 for example. Meanwhile, for the purpose of clearly illustrating the edge 55*b* of the supporting plate 55, it is illustrated in FIG. 2 and the like that the scraper 53 is separated from the edge 55*b* of the supporting plate 55.

In accordance with the present embodiment, the gap between the supporting plate 55 and the fixing plate 56 is referred to as "g". Furthermore, the plate thickness of the scraper 53 is referred to as "t". The relation between the gap and the plate thickness is set up to satisfy the relation g>t, i.e., the gap g is greater than the plate thickness t.

Incidentally, since this scraper 53 is provided with the positioning holes 53*a* and the threaded holes 53*b* as described above, the rigidity tends to decrease in positions corresponding to these holes 53*a* and 53*b*. The contact pressure of the scraper 53 tends thereby to decrease in the positions corresponding to these holes 53*a* and 53*b*. Particularly, when a large quantity of toner is continuously supplied to the cleaning roller 51, a higher bias voltage has to be applied to the cleaning roller 51. This higher bias voltage may generates electric discharge between the cleaning roller 51 and the recovery roller 52 to attach discharge products derived from toner. These discharge products can hardly be removed by the scraper 53 having a low contact pressure.

In the case of the present embodiment, thereby, the scraper 53 is considered by dividing it into a free length L and a base length d in the short dimension direction thereof (the direction perpendicular to the axial direction of the recovery roller 52). The base length d is determined in order to make uniform the contact pressure of the scraper 53 with the recovery roller 52 which is the member to be cleaned.

In this case, the free length L is the distance from the fulcrum position of the supporting plate 55 (i.e., the position corresponding to the edge 55*b*) to the leading edge of the scraper 53. On the other hand, the base length d is the distance from the fulcrum position to the engagement position in which the scraper 53 is engaged with the support member 54, i.e., the fixing plate 56 in this example. The engagement position of the scraper 53 with the support member 54 may correspond to the positioning holes 53*a* or the threaded holes 53*b*. However, in this example, the engagement position corresponds to the edges of the positioning holes 53*a* which are the nearest position to the fulcrum position.

The above parameters may arbitrarily be selected even if the gap g is extremely greater than the plate thickness t as long as the above requirement is satisfied. However, in some of such cases, the system may increase in size. It is thereby desired to determine the plate thickness t and the free length L by taking into consideration the contact pressure required for removing toner, and then determine the gap g and the base length d by taking into consideration an enough space with reference to the plate thickness t and the free length L.

The scraper 53 of the present embodiment is a scraper made of SUS 304 which has, for example, a Young's modulus of 400 GPa and a Vickers hardness of 250 Hv. Also, the scraper 53 has a free length L of 7 mm, a plate thickness t of 70 μm and a base length d of 8 mm. Furthermore, the gap g of the support member 54 is 500 μm. FIG. 8 schematically shows thickness t and gap g. The leading end of the scraper 53 is directed in the reverse (counter) direction to the rotation direction of the recovery roller 52 and brought in contact with the surface of the recovery roller 52 with a contact line pressure of 20 to 180 N/m and a contact angle of 20° to 60°. On the other hand, the recovery roller 52 is made of a SUS and provided with an electroless nickel plating layer having a surface roughness Rz of 0.5 μm. These values are selected to ensure a good scraping performance.

FIG. 4 is an explanatory view for showing the results of experiments for investigating the scraping capability of the scraper 53. In the same figure, "○" indicates a good scraping performance, and "x" indicates an insufficient scraping performance. The experimental results shown in the same figure were obtained by varying the free length L of the scraper 53 and the distance (base length) d between the fulcrum position and the positioning hole 53*a* to verify the scraping capability of the scraper 53.

The free length L of the experiments was set to 4, 6, 8, 10 and 12 mm while the corresponding contact pressure was 260, 80, 30, 15 and 15 N/m respectively. Also, the base length d was set to 4, 6, 8, 10, 12 and 14 mm for each setting of the free length L.

In the case where the base length d was set to 14 mm, a good scraping performance could be observed irrespective of the free length L. On the other hand, in the case where the base length d the base length d was set to 8, 10 and 12 mm, a good scraping performance could be observed except when the free length L was set to the longest value of 4 mm.

However, when the base length d was set to 6 mm, a good scraping performance could be observed only when the free length L was set to 10 and 12 mm while scraping performance was insufficient when the free length L was set to 4, 6 and 8 mm. Further, when the base length d was set to 4 mm, a good scraping performance could be observed only when the free length L was set to 12 mm while scraping performance was insufficient when the free length L was set to 4, 6, 8 and 10 mm.

As can be expected from these experimental results, a good scraping performance can be realized irrespective of the formation of the positioning holes 53*a* and the threaded holes 53*b* by appropriately selecting the base length d of the scraper 53. For example, when the base length d is set to 14 mm, the free length L can be arbitrarily selected among from various values without compromising a good scraping performance. Because of this, a wide choice of the free length L is allowed for designing the scraper 53 to improve the degree of freedom in designing the scraper 53 in accordance with the configuration of the system and the required contact pressure.

In the case of the present embodiment as described above, the cleaning apparatus is comprised of the second transfer cleaning unit 50 including the scraper 53 and the support member 54. The scraper 53 of this cleaning apparatus is a plate-like scraping member which comes in contact with the surface of the recovery roller 52, which is a member to be cleaned, to remove residuals on the surface. The support member 54 serves to support the scraper 53. This support member 54 is provided with the supporting plate 55 for supporting the base portion of the scraper 53, and the fixing plate 56 located opposite the supporting plate 55 at a distance (gap g), which is larger than the plate thickness t of the scraper 53, from the supporting plate 55 in order to hold the base portion of the scraper 53 between the fixing plate 56 and the supporting plate 55.

In this case, the support member 54 has the leading end of the scraper 53 make contact with the surface of the recovery roller 52 by making use of the edge 55*b* of the supporting plate 55 as a fulcrum. Also, the base length d of the scraper 53 from the fulcrum position on the supporting plate 55 to the engagement position with the support member 54 is determined in order to make uniform the contact pressure of the scraper 53 with the recovery roller 52.

The base length d of the scraper 53 is thereby appropriately set up in accordance with the present embodiment as discussed above. By this configuration, it is possible to inhibit decrease of the contact pressure due to the engagement positions with the support member 54 such as the positioning holes 53*a* and the threaded holes 53*b*, and realize a good scraping performance.

In addition, the cleaning apparatus of the present embodiment is provided further with the cleaning roller 51 located in parallel with the second transfer belt 91 and positioned in contact with this second transfer belt 91 which is an image bearing member for bearing toner, the recovery roller 52 located in parallel with the cleaning roller 51 and positioned in contact with this cleaning roller 51, and the voltage application unit 58 which generates an electric field by applying a bias voltage with the polarity opposite to that of toner. The scraper 53 can thereby clean out residuals by being in contact with the surface of the recovery roller 52 as the member to be cleaned.

In the case of an electric field cleaning system using application of a high bias voltage, discharge products derived from toner are attracted to the surface of the member to be cleaned. When the contact pressure of the scraping member is lowered, it is difficult to remove the discharge products of this kind. However, in accordance with the present embodiment, the contact pressure of the scraper 53 can be inhibited from lowering to realize a good scraping performance.

Figure 5A:
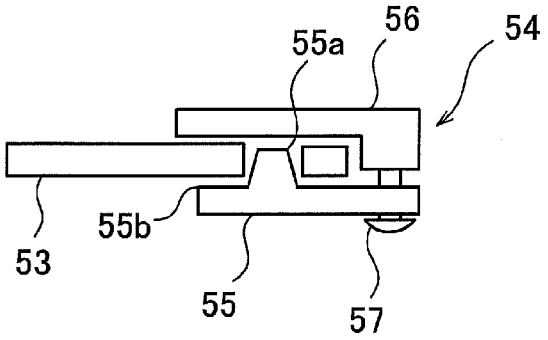
FIG. 5A and FIG. 5B are explanatory views for schematically showing another configuration of the scraper.
Figure 5B:
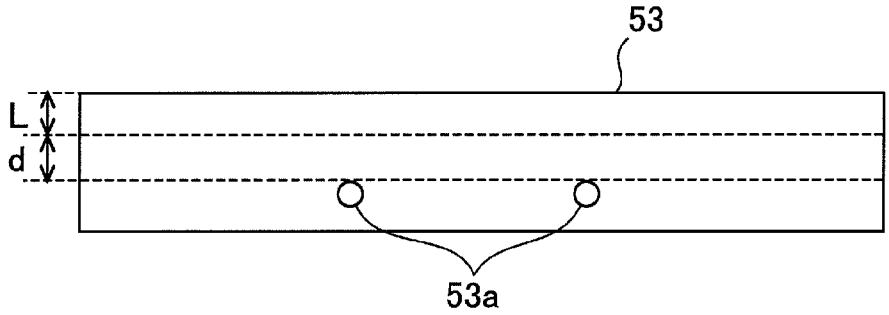

Meanwhile, in the case of the above embodiment, the scraper 53 is held between the supporting plate 55 and the fixing plate 56, and these three parts are fastened with the screws 57. However, as illustrated in FIG. 5A and FIG. 5B, the threaded hole may not be formed through the base portion of the scraper 53 which is supported only by being pinched between the supporting plate 55 and the fixing plate 56 which are fastened with the screws 57. FIG. 5A and FIG. 5B are explanatory views for schematically showing the configuration of the scraper 53. FIG. 5A is an explanatory view for schematically showing the scraper 53 which is held by the support member 54. FIG. 5B is an explanatory view for schematically showing the overall configuration of the scraper 53.

Figure 6A:
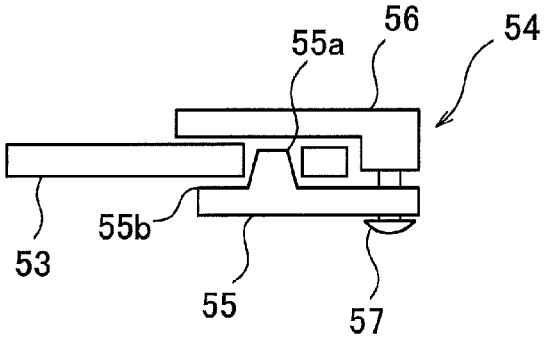
FIG. 6A and FIG. 6B are explanatory views for schematically showing another configuration of the scraper.
Figure 6B:
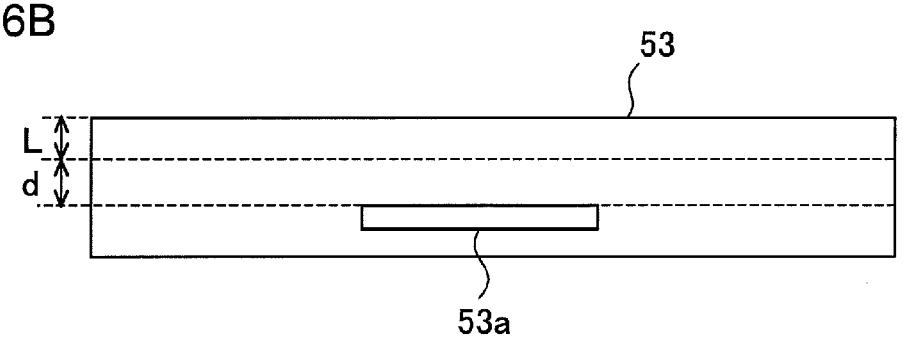

The positioning holes 53*a* are preferably formed at two or more positions in order to prevent the scraper 53 from rotating. However, as illustrated in FIG. 6, a single hole may be formed as the positioning hole 53*a* by opening the hole along a certain length in the width direction of the scraper 53. FIG. 6A and FIG. 6B are explanatory views for showing the configuration of the scraper 53. FIG. 6A is an explanatory view for schematically showing the scraper 53 which is supported by the support member 54. FIG. 6B is an explanatory view for schematically showing the overall configuration of the scraper 53.

While the supporting plate 55 and the fixing plate 56 are connected with screws in the above embodiment, snap-fitting or any other appropriate joining method can be used to fasten the supporting plate 55 and the fixing plate 56.

Furthermore, the scraper 53 of the present embodiment is provided with holes for positioning and fastening. However, in place of such holes, supporting members may be provided to support the scraper 53 at a plurality of points. In this case, the supporting members are arranged in order to satisfy the above requirement for the base length d between the connection position with the supporting members and the fulcrum position supported by the edge 55*b* of the supporting plate 55.

Also, as long as an electric field is induced with the polarity opposite to that of toner on the second transfer belt 91, the polarity of the bias voltage to be applied to the cleaning roller 51 is not limited to that as described above. For example, a negative bias voltage may be applied to the opposite roller 90 with the recovery roller 52 being grounded. Furthermore, the differential potential between the opposite roller 90 and the cleaning roller 51 and the differential potential between the cleaning roller 51 and the recovery roller 52 may be individually controlled by applying a bias voltage also to the cleaning roller 51.

Figure 7:
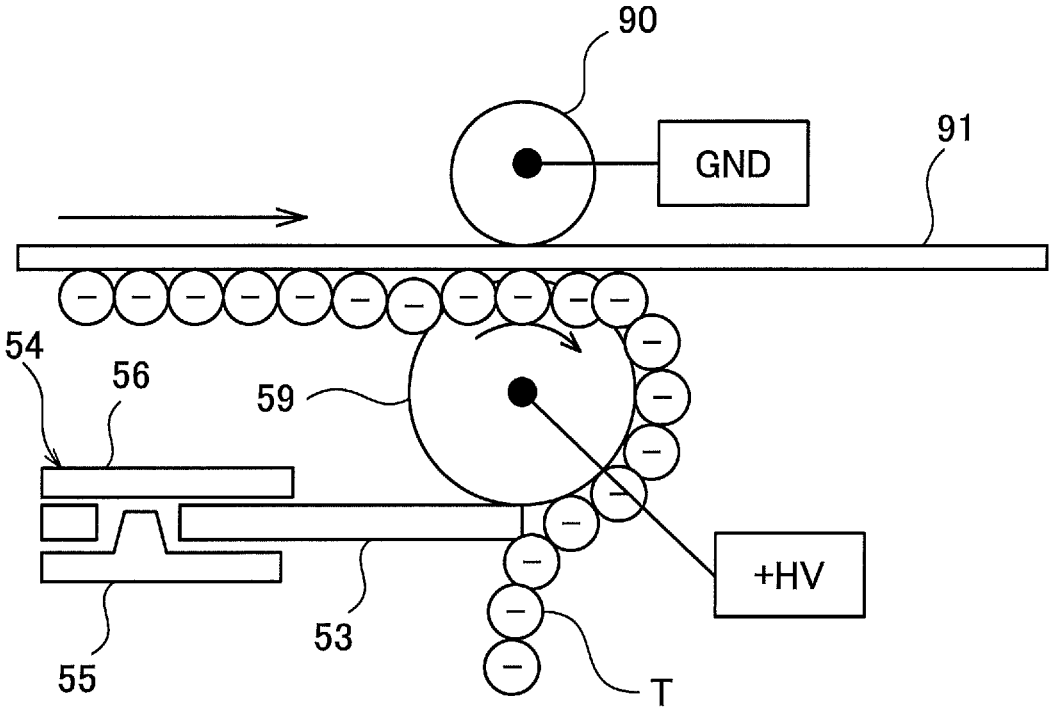
FIG. 7 is an explanatory view for schematically showing another example of the second transfer cleaning unit of the image forming apparatus.

Still further, in order to obtain sufficient cleaning capability, the cleaning roller 51 is not limited to a brush roller but may be a metallic roller 59 as illustrated in FIG. 7. In this case, since the metallic roller 59 of FIG. 7 is used in place of the cleaning roller 51 and brought in slidably contact with the second transfer belt 91, the metallic roller 59 may be driven to rotate in the direction following the rotation of the second transfer belt 91. It is possible for the cleaning roller 51 to maintain a good cleaning capability by setting the rotational speed thereof to 0.8 times to 1.2 times the rotational speed of the second transfer belt 91.

In this configuration, from the view point of maintaining the nip stability, it is preferred to provide the opposite roller 90 with an elastic layer, and apply a low pressure to the opposite roller 90 through the elastic layer. This elastic layer may have a semiconductive property, but is not limited to particular material and conductivity. For example, the elastic layer may be made of a rubber based resin to ensure a good scraping performance by selecting its resistance value of 2 to 8 log Ω.

The foregoing description has been presented on the basis of the image forming apparatus according to the present invention. However, it is not intended to limit the present invention to the precise form described, and obviously many modifications and variations are possible within the scope of the invention. Also, the present invention can be considered to relate also to the cleaning apparatus itself as a part of the image forming apparatus. Furthermore, while a cleaning apparatus of the present invention is implemented as the second transfer cleaning unit of the above embodiment, the present invention can be applied to any other cleaning unit for cleaning an image bearing member such as the intermediate transfer belt. Still further, while the scraper of the cleaning apparatus is in contact with the recovery roller in accordance with the above embodiment, the scraper may be arranged to make contact with the cleaning roller or an image bearing member for forming images (an intermediate transfer member, a second transfer member or the like).

What is claimed is:

1. A cleaning apparatus comprising:

a plate-like scraping member which is in contact with a surface of a member to be cleaned in order to clean out residuals from the surface of the member to be cleaned;

a support member configured to support the plate-like scraping member;

a cleaning roller located in parallel with an image bearing member which bears toner, and positioned in contact with the image bearing member;

a recovery roller located in parallel with the cleaning roller and positioned in contact with the cleaning roller; and a voltage application unit configured to generate an electric field by applying a voltage with a polarity opposite to that of the toner, the voltage application unit further configured to apply a bias voltage from 200 V to 2000 V to the recovery roller, wherein the plate-like scraping member is in contact with a surface of the recovery roller, as the member to be cleaned, in order to clean out residuals from the surface of the recovery roller, the support member comprises:

a supporting plate configured to support a base portion of the plate-like scraping member, the supporting plate arranged to allow contact between the supporting plate and the plate-like scraping member; and a fixing plate located opposite the supporting plate at a distance (g) from the supporting plate to hold the base portion of the plate-like scraping member between the fixing plate and the supporting plate, the plate-like scraping member having a thickness (t), there being an empty space present between the plate-like scraping member and the fixing plate while the plate-like scraping member is in contact with the surface of the member to be cleaned, wherein the empty space corresponds to g minus t, and the empty space is greater than t, the support member causes a leading end of the plate-like scraping member to make contact with the surface of the member to be cleaned by making use of an edge of the supporting plate as a fulcrum, and wherein the plate-like scraping member has a base length from a position of the fulcrum on the supporting plate to an engagement position at which the support member engages the plate-like scraping member, and the base length is capable of pivoting on the fulcrum and allows the plate-like scraping member to contact, with uniform contact pressure, the member to be cleaned, the plate-like scraping member has a Young's modulus of 1 to 400 GPa, a hardness of the recovery roller being equal to or higher than the hardness of the plate-like scraping member, and the recovery roller having a surface roughness Rz of 0.25 to 2.00 μm.

2. The cleaning apparatus of claim 1, wherein the plate-like scraping member is provided with a positioning hole through which a protruding dowel of the supporting plate is inserted to perform positioning the plate-like scraping member, and wherein the engagement position with the support member corresponds to an edge of the positioning hole.

3. The cleaning apparatus of claim 1, wherein the cleaning roller configured to move at a rotational speed that is from 0.8 to 1.2 times that of the image bearing member.

4. The cleaning apparatus of claim 1, wherein the base portion of the plate-like scraping member extends rearward from the leading end of the plate-like scraping member, the base portion has a rear tip located opposite the leading end, and an area immediately rearward of the rear tip is unoccupied by the support member.

5. An image forming apparatus comprising:

an image forming unit provided with an image bearing member for bearing toner and configured to transfer an image to a sheet;

a cleaning apparatus configured to clean the surface of the image bearing member, a cleaning roller located in parallel with the image bearing member which bears the toner, and positioned in contact with the image bearing member;

a recovery roller located in parallel with the cleaning roller and positioned in contact with the cleaning roller; and a voltage application unit configured to generate an electric field by applying a voltage with a polarity opposite to that of the toner, the voltage application unit further configured to apply a bias voltage from 200 V to 2000 V to the recovery roller, wherein the cleaning apparatus comprises:

a plate-like scraping member which is in contact with a surface of the recovery roller in order to clean out residuals from the surface of the recovery roller; and a support member configured to support the plate-like scraping member, the support member comprising:

a supporting plate configured to support a base portion of the plate-like scraping member, the supporting plate arranged to allow contact between the supporting plate and the plate-like scraping member; and a fixing plate located opposite the supporting plate at a distance (g) from the supporting plate to hold the base portion of the plate-like scraping member between the fixing plate and the supporting plate, the plate-like scraping member having a thickness (t), there being an empty space present between the plate-like scraping member and the fixing plate while the plate-like scraping member is in contact with the surface of the recovery roller, wherein the empty space corresponds to g minus t, and the empty space is greater than t, the support member causes a leading end of the plate-like scraping member to make contact with the surface of the recovery roller by making use of an edge of the supporting plate as a fulcrum, and wherein the plate-like scraping member has a base length from a position of the fulcrum on the supporting plate to an engagement position at which the support member engages the plate-like scraping member, the base length is capable of pivoting on the fulcrum and allows the plate-like scraping member to contact, with uniform contact pressure, the recovery roller, the plate-like scraping member has a Young's modulus of 1 to 400 GPa, a hardness of the recovery roller is equal to or higher than the hardness of the plate-like scraping member, and the recovery roller has a surface roughness Rz of 0.25 to 2.00 μm.

6. The image forming apparatus of claim 5, wherein the plate-like scraping member is provided with a positioning hole through which a protruding dowel of the supporting plate is inserted to perform positioning the plate-like scraping member, and wherein the engagement position with the support member corresponds to an edge of the positioning hole.

7. The image forming apparatus of claim 5, wherein the cleaning roller configured to move at a rotational speed that is from 0.8 to 1.2 times that of the image bearing member.

8. The image forming apparatus of claim 5, wherein the base portion of the plate-like scraping member extends rearward from the leading end of the plate-like scraping member, the base portion has a rear tip located opposite the leading end, and an area immediately rearward of the rear tip is unoccupied by the support member.

* * * * *